US005803875A

United States Patent [19]

Colace

[11] Patent Number: 5,803,875

[45] Date of Patent: Sep. 8, 1998

[54] WRESTLING TRAINING APPARATUS

[76] Inventor: Carmine Colace, 125 E. Central St., Franklin, Mass. 02038

[21] Appl. No.: 818,852

[22] Filed: Mar. 17, 1997

[51] Int. Cl.[6] ..... A63B 69/00

[52] U.S. Cl. ..... 482/83; 482/87; 473/520

[58] Field of Search ..... 482/83–90; 473/520, 473/473, 294–296, 214

[56] References Cited

U.S. PATENT DOCUMENTS

| | | | |
|---|---|---|---|
| 546,540 | 9/1895 | Kennedy | 473/520 |
| 835,796 | 11/1906 | Lindslay | 482/83 |
| 3,663,019 | 5/1972 | Palotsee | 473/296 |
| 3,937,468 | 2/1976 | Condo, Sr. | 482/83 |
| 5,183,450 | 2/1993 | Stelmach | 482/83 |
| 5,516,097 | 5/1996 | Huddeston | 473/520 |
| 5,595,385 | 1/1997 | Jablonski | 473/295 |

*Primary Examiner*—Jerome Donnelly
*Attorney, Agent, or Firm*—Kriegsman & Kriegsman

[57] ABSTRACT

An apparatus for wrestling training includes a first elongated member having a first end and a second end. The first elongated member is generally L-shaped and is sized and shaped so as to simulate the lower portion of a human leg. The apparatus also includes a second elongated member having a first end and a second end. The first end of the first elongated member is pivotally connected to the first end of the second elongated member by a central linking member. The central linking member is flexible to enable the first elongated member to pivot in both anterior-posterior and rotational relation relative to the second elongated member to closely simulate the range of motion of a human leg. The second end of the second elongated member is shaped to form a handle which enables said apparatus to be hand held during use.

6 Claims, 4 Drawing Sheets

WRESTLING TRAINING APPARATUS

BACKGROUND OF THE INVENTION

The present invention relates generally to athletic training devices and more particularly to a wrestling training apparatus.

In the sport of wrestling, two participants of the same relative size compete with one another in a contest in which each of the two opponents struggles hand to hand in an attempt to force the other down. Wrestling contests are commonly engaged at the high school, collegiate and olympic levels of competition.

In order to effectively train for wrestling competitions, wrestling participants, also commonly referred to as wrestlers, often practice various wrestling maneuvers and techniques on a partner.

As a first drawback of this means of training, often a wrestler may not have a training partner. Or, if the wrestler does have a partner with whom to train, very often the partner is not of the same size or strength as the wrestler. Forced to train without a suitable partner, a wrestler is limited in the level in which he can adequately prepare for future competitions.

As a second drawback of this means of training, the training partner of the wrestler is often subject to injury as the wrestler practices techniques. In particular, very often a wrestler will practice wrestling techniques which focus on the lower leg of an opponent. As an example, a common wrestling style involves the wrestler attacking or lunging towards the lower portion of one of the legs of an opponent. This style is often referred to as a low level single leg attack in the art. Because the wrestler attacks the lower leg of the opponent using this technique, the knee and ankle of the training partner become subject to serious injury. As a consequence, most training partners are weary of acting in this capacity, thereby precluding the wrestler from adequate preparation.

It should also be noted that if the training partner is also to serve as a coach or a teacher for the wrestler, the partner is often in a poor position in which to evaluate and instruct the wrestler concerning the execution of his techniques.

SUMMARY OF THE INVENTION

It is an object of the present invention to provide a new and useful apparatus for wrestling training.

It is another object of the present invention to provide a new and useful apparatus for wrestling training which enables a wrestler to practice wrestling techniques and maneuvers which focus on the lower leg of an opponent, such as low level single leg attacks.

It is yet another object of the present invention to provide an apparatus for wrestling training as described above which has a limited number of parts, is inexpensive to manufacture and is easy to use.

Accordingly, there is provided an apparatus for wrestling training comprising a first elongated member having a first end and a second end, said first elongated member being sized and shaped so as to simulate the lower portion of a human leg, a second elongated member having a first end and a second end and a central linking member for connecting the first end of said first elongated member to the first end of said second elongated member.

Additional objects, as well as features and advantages, of the present invention will be set forth in part in the description which follows, and in part will be obvious from the description or may be learned by practice of the invention. In the description, reference is made to the accompanying drawings which form a part thereof and in which is shown by way of illustration various embodiments for practicing the invention. The embodiments will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense, and the scope of the present invention is best defined by the appended claims.

BRIEF DESCRIPTION OF THE DRAWINGS

The accompanying drawings, which are hereby incorporated into and constitutes a part of this specification, illustrate one embodiment of the invention and, together with the description, serve to explain the principles of the invention. In the drawings wherein like reference numerals represent like parts.

DETAILED DESCRIPTION OF A PREFERRED EMBODIMENT

Figure 1:
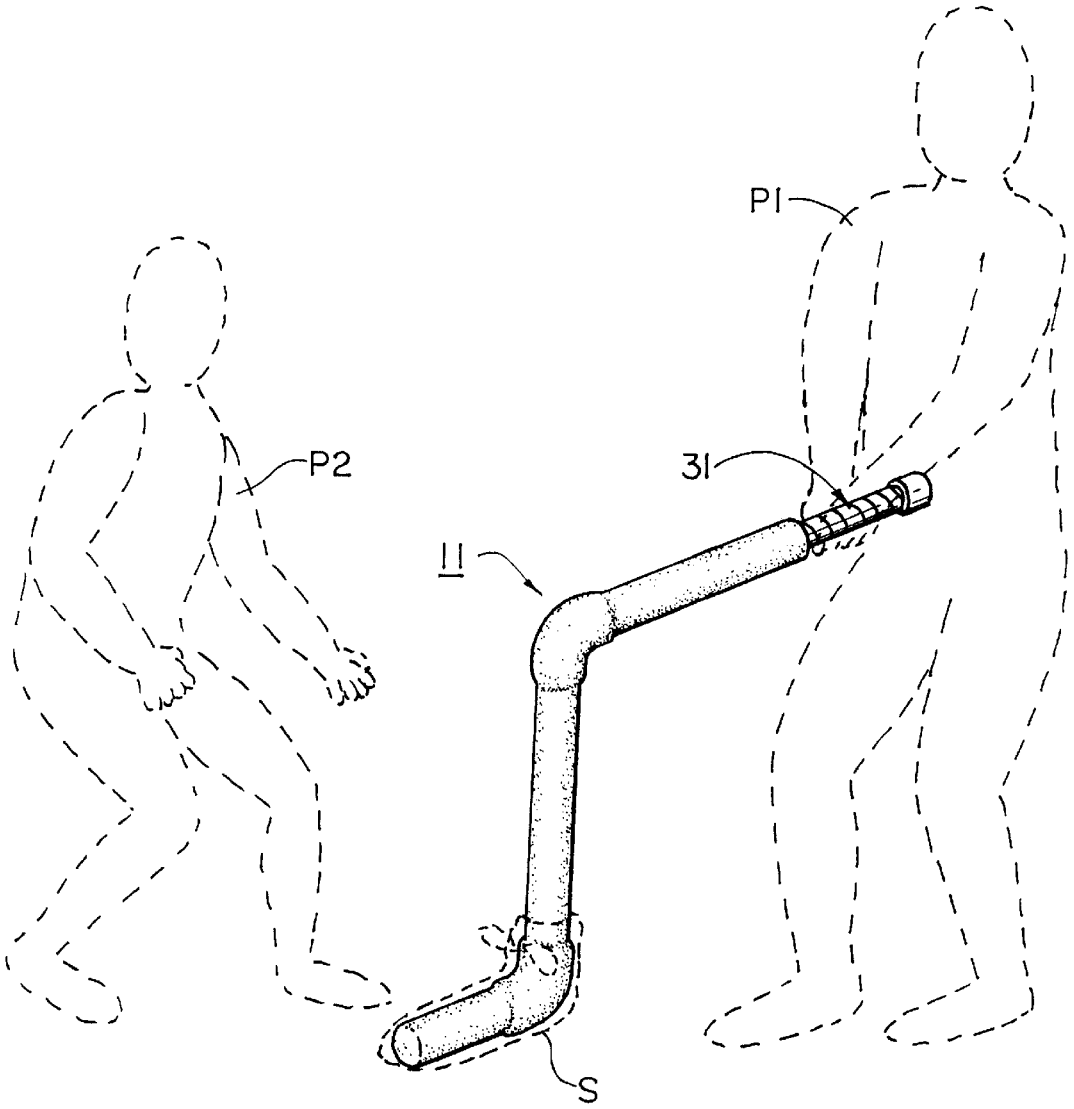
FIG. 1 is a perspective view of an apparatus for wrestling training constructed according to the teachings of the present invention, the apparatus being shown with a first person holding the apparatus while a second person practices wrestling techniques thereon, the apparatus also being shown with a conventional wrestling shoe mounted thereon, the first person, the second person and the wrestling shoe all being shown in phantom.

Referring now to FIG. 1, there is shown a perspective view of an apparatus for wrestling training constructed according to the teachings of the present invention, the apparatus being represented generally by reference numeral 11. Apparatus 11 is generally in the shape of a human leg and is shown with a first person P1 holding apparatus 11 while a second person P2 practices wrestling techniques thereon. Apparatus 11 is also shown with a conventional wrestling shoe S mounted thereon.

Figure 2:
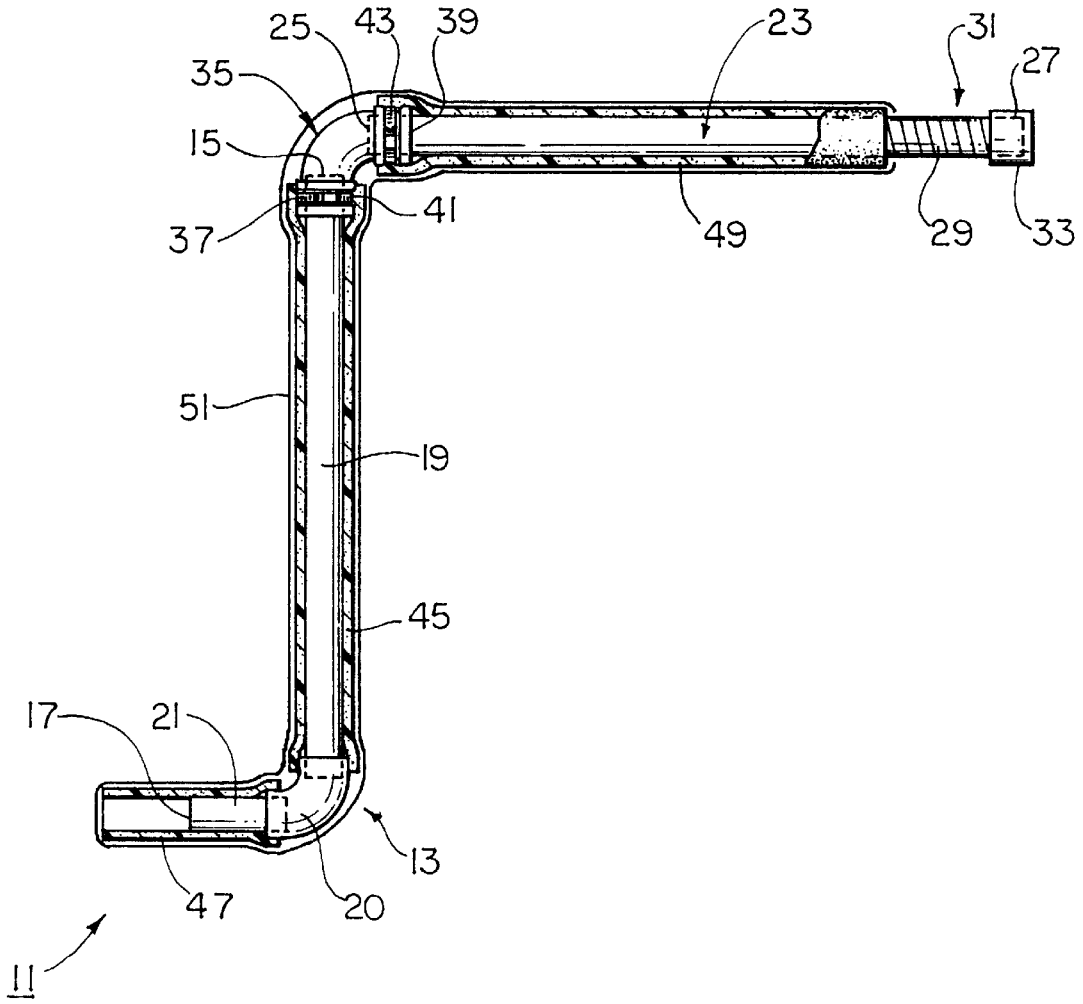
FIG. 2 is a right side section view of the apparatus of FIG. 1.
Figure 3:
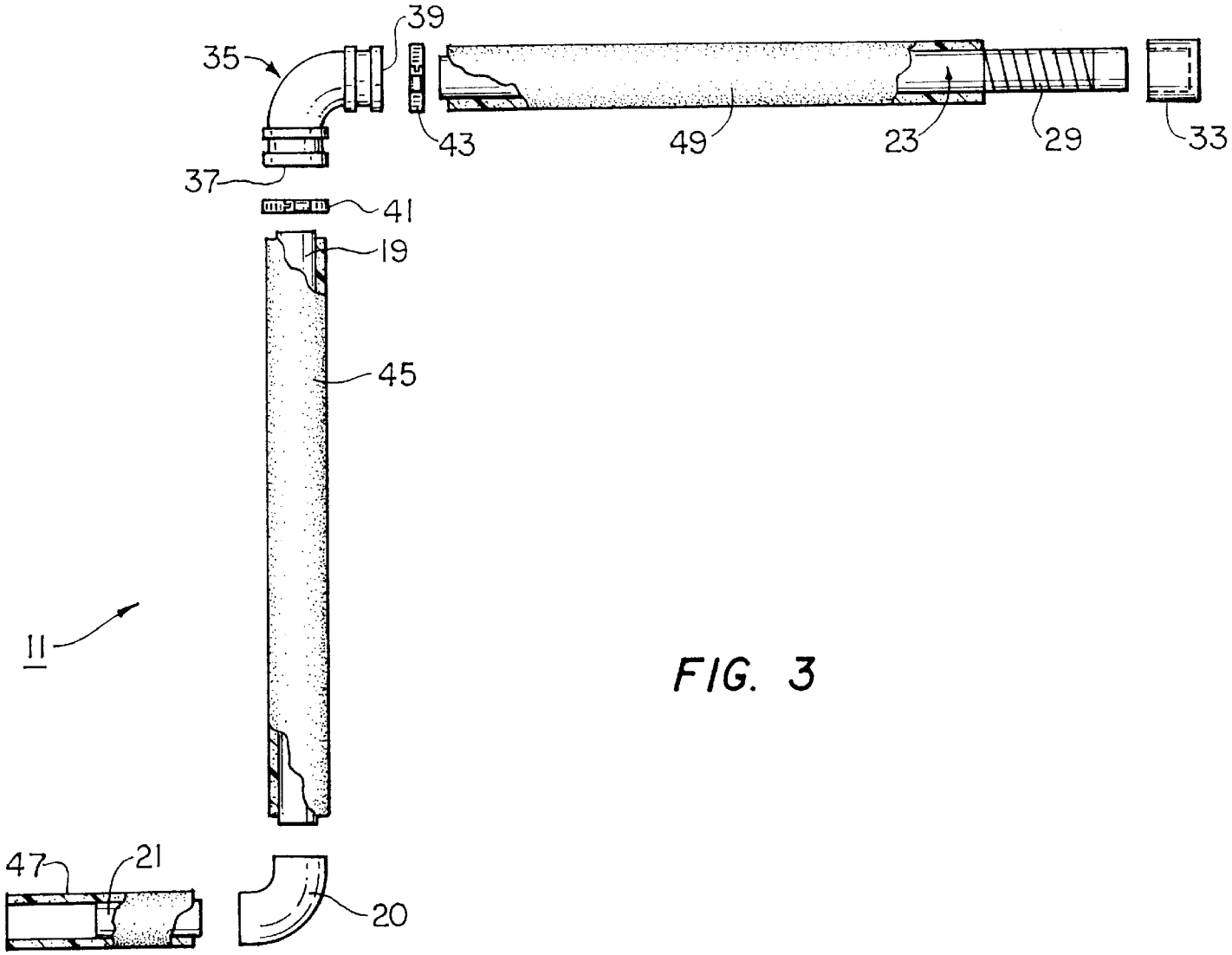
FIG. 3 is an exploded, right side section view of the apparatus of FIG. 1, the apparatus being shown without the slip cover.

Referring now to FIGS. 2 and 3, apparatus 11 comprises a lower leg assembly 13 which is sized and shaped so as to simulate the lower portion of a human leg, the lower portion referring to the portion of a human leg from just underneath the knee down to and including the foot. Lower leg assembly 13 is generally L-shaped and includes a first end 15 and a second end 17.

Lower leg assembly 13 comprises a vertical member 19 which simulates the region of a human leg from just below the knee to just above the ankle, vertical member 19 being approximately 15 inches in length, a curved member 20 which simulates the heel and ankle of a human leg and a horizontal member 21 which simulates the foot of a human leg, horizontal member 21 being approximately 3 inches in length. Curved member 20 has a 90 degree bend and includes a pair of openings into which vertical member 19 and horizontal member 21 are affixed, such as by cement or other securing means, to form a single, elongated L-shaped member. Members 19, 20 and 21 are constructed out of, but not limited to, a rigid and durable material such as polyvinyl chloride (PVC) piping.

Apparatus 11 further includes an elongated member 23 which is similarly constructed out of a rigid and durable material such as polyvinyl chloride (PVC) piping. Elongated member 23 is generally straight and includes a first end 25 and a second end 27. Elongated member 23 is approximately 28 inches in length and is sized and shaped so as to simulate the region of a human leg from just above the knee to just below the pelvis. Member 23 additionally serves as an extension means for first person P1 to position lower leg assembly 13 out and away from person P1 in use, as will be described in detail below.

The region of elongated member 23 proximate second end 27 is wrapped with a gripping material 29 such as tape so as to create a no-slip handle 31 for holding apparatus 11, handle 31 having an approximate length of 8 inches. A cap 33 is mounted onto second end 27 to further prevent the hands of first person P1 from slipping off of handle 31.

Lower leg assembly 13 is pivotally connected to elongated member 23 by a flexible central linking member 35. Central linking member 35 has a 90 degree bend and includes a first opening 37 and a second opening 39. First end 15 of lower leg assembly 13 is positioned within first opening 37 of central linking member 35 and held securely in place by a first clamp assembly 41. Similarly, first end 25 of elongated member 23 is positioned within second opening 39 of central linking member 35 and held securely in place by a second clamp assembly 43. Clamp assemblies 41 and 43 can be any type of conventional clamp assemblies. For example, assemblies 41 and 43 may comprise a one piece metal ring having a slot formed therein to form a pair of free ends which can be connected together by a screw, wherein turning the screw can either increase or decrease the circumference of the ring. Lower leg assembly 13 and elongated member 23 could also be permanently affixed to central linking member 35 by other securing means, such as by an adhesive.

Central linking member 35 is constructed out of a flexible and resilient material such as rubber so as to closely simulate the range of motion of the knee joint of a human leg. In the absence of any outside forces, central linking member 35 is naturally biased so as to position vertical portion 19 of first elongated member 13 approximately perpendicular to second elongated member 23. However, due to its construction, central linking member 35 enables for first elongated member 13 to be pivoted in both anterior-posterior and rotational relation relative to second elongated member 23 to simulate the range of motion of a human leg.

Apparatus 11 also comprises a first padding member 45 which is wrapped around vertical portion 19, a second padding member 47 which is wrapped around horizontal portion 21 and a third padding member 49 which is wrapped around second elongated member 23 proximate first end 25. Padding members 45, 47 and 49 are all constructed of a soft material such as foam rubber and serve to soften apparatus 11 to prevent injury. It should be noted that second padding member 47 extends approximately three inches past second end 17 of lower leg assembly 13.

Apparatus 11 further comprises a slip covering 51 which covers the entire length of apparatus 11 except for handle 31. Slip covering 51 is preferably constructed of a thin, LYCRA material so as to give apparatus 11 a single outer surface for aesthetic purposes. It should be noted that a conventional wrestling shoe may be mounted onto the foot portion of apparatus 11 over slip cover 51 so as to closely simulate the look and feel of the leg of a wrestling opponent.

In use, apparatus 11 can be used for wrestling training in the following manner. A first person P1, standing upright, grasps handle 31 of apparatus 11. Preferably, first person P1 extends his arms out straight so as to position first elongated member 13 out and away from his body to remove any risk of injury. A second person P2 is then able to perform on apparatus 11 any variety of wrestling maneuvers which concentrate on the leg of a wrestler, such as low level single leg attacks. Because person P1 is standing upright and is holding apparatus 11 out and away from his body, person P1 is afforded a quality viewing perspective for which to watch second person P2 practice wrestling techniques on apparatus 11. Furthermore, it can be appreciated that first person P1 need not be of the same size or strength of second person P2 to enable second person P2 to practice wrestling techniques. Rather, first person P1 needs only to have the physical ability to hold apparatus 11.

Although apparatus 11 is shown being held by a first person P1 so that a second person P2 can practice wrestling maneuvers thereon, it should be known that handle 31 of apparatus 11 could also be secured to a fixed object, such as a recess in a wall, to enable second person P2 to practice wrestling techniques without the need of a partner.

Figure 4:
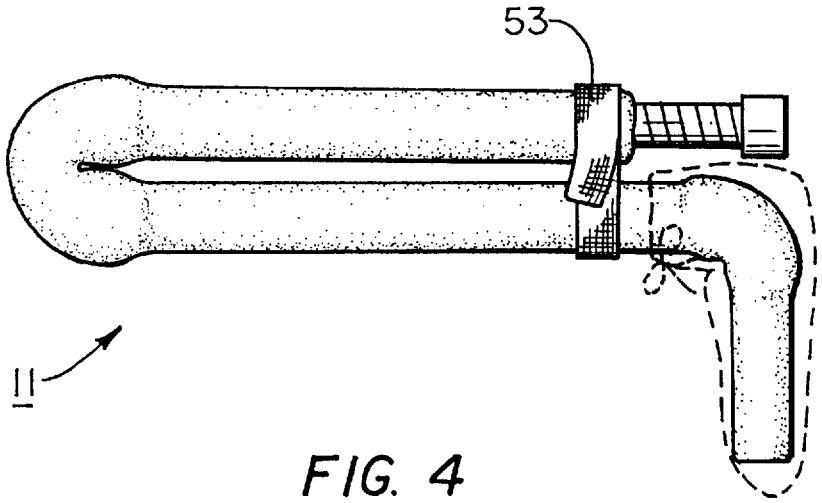
FIG. 4 is a right side view of the apparatus of FIG. 1, the apparatus being shown held together for storage by a strap.

Upon the completion of wrestling training, vertical portion 19 of lower leg assembly 13 13 can be pivoted towards, and in direct contact with elongated member 23, as shown in FIG. 4. A conventional strap 53 can be used to tie lower leg assembly 13 and member 23 together in this position so as to enable apparatus 11 to be stored away in a relatively small space such as a gym bag. It should be noted that strap 53 may be a separate, removable piece or may be permanently attached to apparatus 11.

The embodiment of the present invention described above is intended to be merely exemplary and those skilled in the art shall be able to make numerous variations and modifications to it without departing from the spirit of the present invention. All such variations and modifications are intended to be within the scope of the present invention as defined in the appended claims.

What is claimed is:

1. An apparatus simulating a human leg for use in wrestling training comprising:

(a). a lower leg assembly having a first end and a second end, said lower leg assembly having an L-shaped configuration and being sized and shaped so as to simulate the lower portion of a human leg, said lower leg assembly comprising an elongated, straight, vertical member made of rigid material, a curved member having a 90 degree bend and made of rigid material and a first elongated, straights, horizontal member made of rigid material;

(b). a second elongated, straight, horizontal member made of rigid material and having a first end, a second end and being sized and shaped to simulate the region of the human leg from just above the knee to just below the pelvis; and (c). a central linking member connecting the first end of said lower leg assembly to the first end of said second elongated, straight, horizontal member in a Z-shaped configurations, said central linking member having a 90 degree bend and being constructed of a flexible resilient material to permit resilient articulation of said elongated, straight, vertical member in both an anterior-posterior direction and rotationally relative to said second elongated, straight, horizontal member so as to simulate the range of motion of a knee joint of a human leg, and (d). padding on said first elongated, straight, horizontal member and said elongated, straight, vertical member to prevent injury during use.

2. The apparatus for wrestling training of claim 1 wherein the second end of second member is shaped to form a handle for enabling said apparatus to be hand held during use.

3. The apparatus for wrestling training of claim 2 wherein the first end of said first elongated member is connected to said central linking member by a first clamp assembly and the first end of said second elongated member is connected to said central linking member by a second clamp assembly.

4. The apparatus for wrestling training of claim 3 wherein said first and second elongated members are constructed of polyvinyl chloride piping.

5. The apparatus of claim 1 wherein said elongated, straight, vertical member simulates the region of a human leg from just below the knee to just above the ankle, said curved member simulates the heel and ankle of a human leg and said first elongated, straight, horizontal member simulates the foot of a human leg and wherein said central linking member resiliently biases the elongated, straight, vertical member at a position approximately perpendicular to said second elongated, straight, horizontal member.

6. The apparatus of claim 1 and further including a slip covering on at least said lower leg assembly and said central linking member.

* * * * *